US006300304B1

(12) United States Patent
Boeckh et al.

(10) Patent No.: US 6,300,304 B1
(45) **Date of Patent: *Oct. 9, 2001**

(54) PROPOXYLATED/ETHOXYLATED POLYALKYLENEIMINE DISPERSANTS

(75) Inventors: Dieter Boeckh, Limburgerhof; Michael Ehle, Ludwigshafen; Angelika Funhoff, Mannheim; Jürgen Mohr, Grünstadt, all of (DE); James A. Cleary, Indian Springs, OH (US); Shulin Zhang, West Chester, OH (US); Eugene Paul Gosselink, Cincinnati, OH (US)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/549,606

(22) Filed: Apr. 14, 2000

Related U.S. Application Data

(63) Continuation of application No. 09/102,556, filed on Jun. 23, 1998, now Pat. No. 6,156,720.

(51) Int. Cl.[7] ..... C11D 3/37
(52) U.S. Cl. ..... 510/475
(58) Field of Search ..... 510/475

(56) References Cited

U.S. PATENT DOCUMENTS

| | | | |
|---|---|---|---|
| 5,565,145 | 10/1996 | Watson et al. | 510/350 |
| 5,851,672 | 12/1998 | Wang et al. | 428/407 |

FOREIGN PATENT DOCUMENTS

| | | | |
|---|---|---|---|
| 2 227 546 | | 1/1974 | (DE) . |
| 27 19 978 | | 11/1978 | (DE) . |
| 0 112 593 | | 7/1984 | (EP) . |
| 1597097 | * | 9/1981 | (GB) . |
| 95/33018 | | 12/1995 | (WO) . |
| 97/42291 | | 11/1997 | (WO) . |
| 97/42292 | | 11/1997 | (WO) . |
| 99/01530 | | 1/1999 | (WO) . |

* cited by examiner

*Primary Examiner*—John Hardee
(74) *Attorney, Agent, or Firm*—Oblon, Spivak, McClelland, Maier & Neustadt, P.C.

(57) ABSTRACT

The present invention relates to an alkoxylated polyalkyleneimine soil dispersant having the formula:

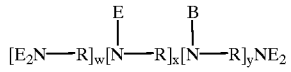

wherein R is $C_2$–$C_6$ linear alkylene, $C_3$–$C_6$ branched alkylene, and mixtures thereof; B is a continuation by branching; E is an alkyleneoxy unit having the formula:

$$—(R^1O)_m(R^2O)_nR^3$$

wherein $R^1$ is 1,2-propylene, 1,2-butylene, and mixtures thereof; $R^2$ is ethylene; $R^3$ is hydrogen, $C_1$–$C_4$ alkyl, and mixtures thereof; m is from about 1 to about 10; n is from about 10 to about 40; w, x and y are each independently from about 4 to about 200; provided at least one —($R^1$O) unit is attached to the backbone prior to attachment of an —($R^2$O) unit and further provided m+n is at least 12.

4 Claims, No Drawings

PROPOXYLATED/ETHOXYLATED POLYALKYLENEIMINE DISPERSANTS

This application is a Continuation of application Ser. No. 09/102,556 filed on Jun. 23, 1998 now U.S. Pat. No. 6,156,720.

FIELD OF THE INVENTION

The present invention relates to alkoxylated polyalkyleneimine hydrophobic soil dispersants which are suitable for use as soil dispersant in applications.

BACKGROUND OF THE INVENTION

Absent a suitable dispersant, hydrophobic (e.g. grime, oil, soot) and hydrophilic (e.g. clam) soil which is removed during the washing step of the laundry process can re-deposit onto the cleaned fabric. Soil dispersants act by sequestering dirt once it is dissolved or dispersed in the laundry liquor and keeps the suspended soil in the laundry liquor where it can be carried away during the normal rinsing process.

Typically, if bleaching agents are present, especially peroxygen bleaches which are formulated into both liquid and granular laundry detergent compositions, the formulator must consider the instability of a particular soil dispersant toward bleach. Many successful dispersants have polyalkyleneamine or polyalkyleneimine backbones which are susceptible to oxidation at the amine functionalities and potentially to breakdown or fragmentation by bleaching agents which may be present. From another view, the interaction of bleaching agents with these polyalkyleneimine-based dispersants depletes the amount of bleach present therefore affecting the bleaching performance.

Accordingly, there remains a need in the art for bleach compatible, highly effective hydrophobic soil dispersants. Surprisingly, it has been found that certain higher molecular weight polyalkyleneimines which comprise a mixture of alkyleneoxy units which are appended to a polyalkyleneimine backbone in a particular order provide hydrophobic dispersants having enhanced bleach compatibility as well as enhanced dispersancy.

SUMMARY OF THE INVENTION

The present invention meets the aforementioned needs in that is has been surprisingly discovered that polyalkyleneimines having a backbone molecular weight of from about 600 daltons to about 25000 daltons wherein the backbone nitrogens have been substituted by an average degree of mixed alkyleneoxylation per N—H unit of from 12 to about 50 alkyleneoxy units provides an enhanced hydrophilic soil dispersant which is combustible with bleach. The polyamine backbone is first modified by placement of from 1 to 10 propyleneoxy units, butyleneoxy units, and mixtures thereof followed by ethyleneoxy units such that the total degree of alkyleneoxylation does not exceed about 50 units. The alkoxylated polyalkyleneimines of the present invention are suitable for use in high and low density granular, heavy duty and light duty liquids, as well as laundry bar detergent compositions.

The present invention relates to a soil dispersant having the formula:

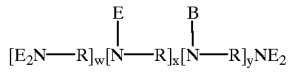

wherein R is $C_2$–C6 linear alkylene, $C_3$–$C_6$ branched alkylene, and mixtures thereof; B is a continuation by branching; E is an alkyleneoxy unit having the formula:

$$—(R^1O)_m(R^2O)_nR^3$$

wherein $R^1$ is 1,2-propylene, 1,2-butylene, and mixtures thereof; $R^2$ is ethylene; $R^3$ is hydrogen, $C_1$–$C_4$ alkyl, and mixtures therof; m is from about 1 to about 10; n is from about 10 to about 40; w, x and y are each independently from about 4 to about 200; provided at least one —($R^1$O) unit is attached to the backbone prior to attachment of an —($R^2$O) unit and further provided m+n is at least 12.

These and other objects, features, and advantages will become apparent to those of ordinary skill in the art from a reading of the following detailed description and the appended claims.

All percentages, ratios and proportions herein are by weight, unless otherwise specified. All temperatures are in degrees Celsius (° C.) unless otherwise specified. All documents cited are in relevant part, incoporated herein by reference.

DETAILED DESCRIPTION OF THE INVENTION

The present invention relates to polyalkyleneimine dispersants which are polyalkyleneoxy substituted wherein propyleneoxy units, butyleneoxy units, and mixtures thereof are attached to the backbone nitrogens prior to subsequent attachment of polyethyleneoxy units. The polyamine backbones of the present invention have the general formula:

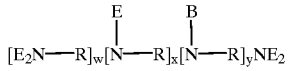

said backbones prior to subsequent modification, comprise primary, secondary and tertiary amine nitrogens connected by R "linking" units. The backbones are comprised of essentially three types of units, which may be randomly distributed along the chain.

The units which make up the polyalkyleneimine backbones are primary units having the formula:

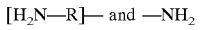

which terminate the main backbone and any branching chains, secondary amine units having the formula:

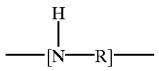

and which, after modification, have their hydrogen atom substituted by from 1 to 10 propyleneoxy units, butyleneoxy units, and mixtures thereof followed by from 10 to 40 ethyleneoxy units, and tertiary amine units having the formula:

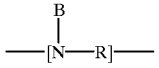

which are the branching points of the main and secondary backbone chains, B representing a continuation of the chain structure by branching. The tertiary units have no replaceable hydrogen atom and are therefore not modified by substitution with an alkyleneoxy unit. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines. R is $C_2$–$C_6$ linear alkylene, $C_3$–$C_6$ branched alkylene and mixtures therof, preferred branched alkylene is 1,2-propylene, preferred R is ethylene. The preferred polyalkyleneimines of the present invention have backbones which comprise the same R unit, for example, all units are ethylene. Most preferred backbone comprises R groups which are all ethylene units.

The polyalkyleneimines of the present invention are modified by substitution of each N—H unit hydrogen with an alkyleneoxy unit having the formula:

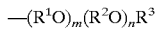

Wherein $R^1$ is 1,2-propylene, 1,2-butylene, and mixtures thereof, preferably 1,2-propylene. $R^2$ is ethylene. $R^3$ is hydrogen, $C_1$–$C_4$ alkyl, and mixtures thereof, preferably hydrogen or methyl, more preferably hydrogen. For the purposes of the present invention, at least one propyleneoxy or butyleneoxy unit must be attached to the backbone nitrogen units prior to substitution with any other alkyleneoxy unit. The value of the index m is from about 1, preferably from about 2 to about 10, preferably to about 6, more preferably to about 5. The value of the index n is from about 10, preferably from about 15, more preferably from about 20 to about 40, preferably to about 35, more preferably to about 30. The value of m+n is preferably at least 12, more preferably from about 15, most preferably from about 20 to about 40, more preferably to about 35. An example of a preferred polyalkyleneoxy substituent comprises three 1,2-propyleneoxy units prior to subsequent ethoxylation, especially when the average value of m+n is about 30.

The preferred molecular weight for the polyamine backbones is from about 600 daltons, preferably from about 1200 daltons, more preferably from about 1800 daltons, most preferably from about 2000 daltons to about 25000 daltons, preferably to about 20000 daltons, more preferably to about 15000 daltons, most preferably 5000 daltons. An example of a preferred molecular weight for a polyethyleneimine backbone is 3000 daltons. The indices x and y needed to achieve the preferred molecular weights will vary depending upon the R moiety which comprises the backbone. For example, when R is ethylene a backbone unit averages about 43 gm and when R is hexylene a backbone unit averages about 99 gm, The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid etc. Specific methods for preparing these polyamine backbones are disclosed in U.S. Pat. No. 2,182,306, Ulrich et al., issued Dec. 5, 1939; U.S. Pat. No. 3,033.746, Mayle et al., issued May 8, 1962; U.S. Pat. No. 2,208,095, Esselmann et al., issued Jul. 16, 1940; U.S. Pat. No. 2,806,839. Crowther, issued Sep. 17, 1957; and U.S. Pat. No. 2,553, 696, Wilson, issued May 21, 1951; all herein incoporated by reference.

The following is an example of a preferred embodiment of the present invention, polyethyleneimine (R equal to ethylene) having an average backbone molecular weight of about 3000 having the formula:

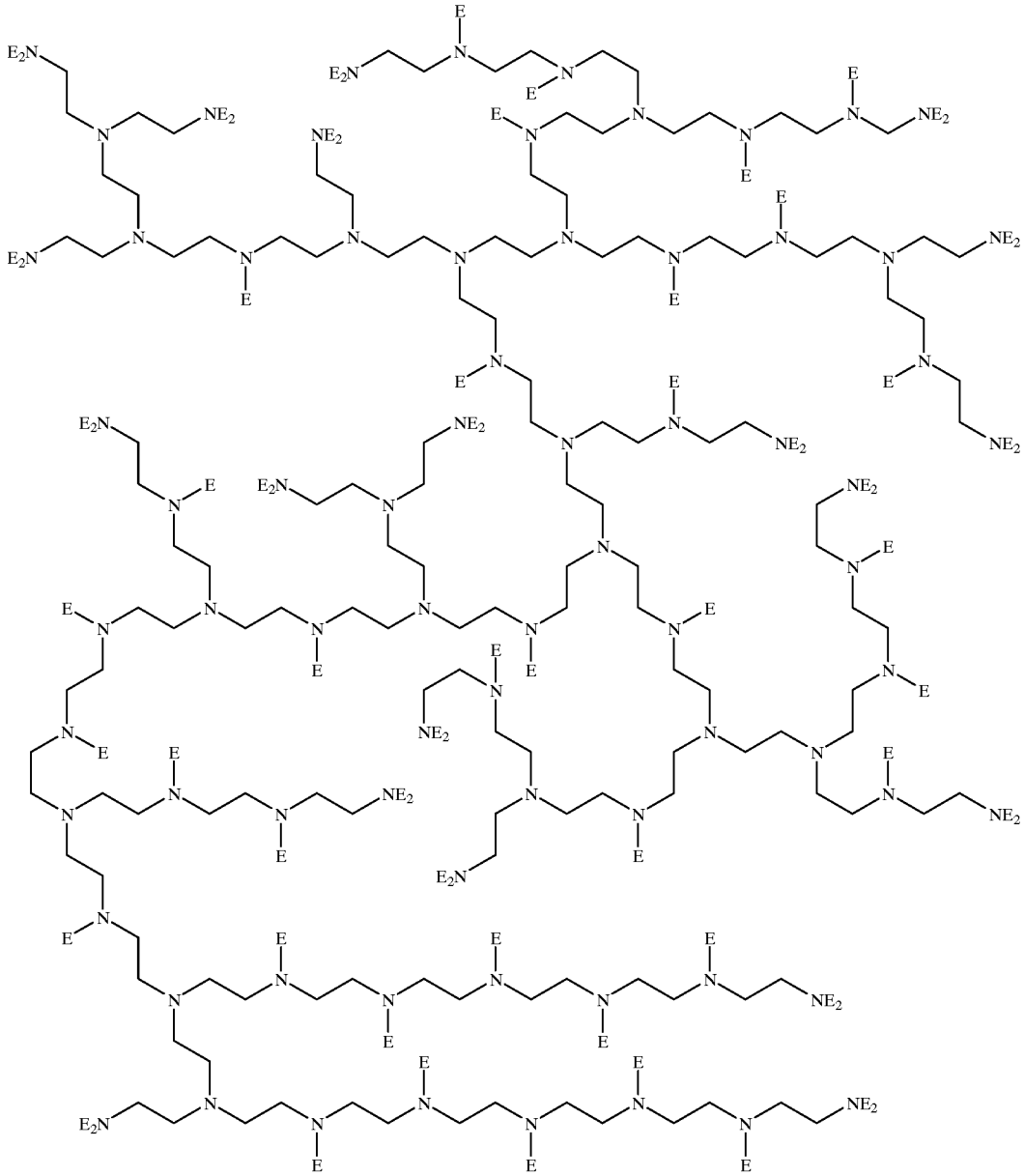

wherein E represents —$(R^1O)_m(R^2O)_n$ $R^3$ wherein R is a 1,2-propylene unit having the formula:

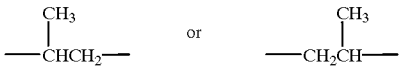

$R^2$ is ethylene, $R^3$ is hydrogen an m+n is equal to about 30.

The modification of the N—H units in the polymer with propylene oxide, butylene oxide and ethylene oxide units is carried out by first reacting the polymer, preferably polyethyleneimine, with propylene oxide, butylene oxide and mixtures thereof and then adding ethylene oxide. In more detail, for instance, polyethyleneimine is first reacted with propylene oxide in the presence of up to about 70 % by weight of water at a temperature of from 25 to 150° C. in an autoclave fitted with a stirrer. In the first step of the reaction propylene oxide is added in such an amount that nearly all hydrogen atoms of the N—H-groups of the polyethyleneimine are converted into hydroxy propyl groups. The water is then removed from the autoclave. After the addition of a basic catalyst, for example sodium methylate, potassium tertiary butylate, potassium hydroxide, sodium hydroxide, sodium hydride, potassium hydride or an alkaline ion exchanger in an amount of 0,1 to 15 %, by weight with reference to the addition product obtained in the first step of the propoxylation, further amounts of propylene oxide are added to the reaction product of the first step so that a propoxylated polyethyleneimine is obtained which contains 1–10, preferably 2 to 5, most preferably 3 to 4, propylene oxide units per N—H group of the polymer. The second step is carried out for instance at temperatures of from 60 to 150° C.

After the addition of propylene oxide to polyethyleneimine in the said amounts the reaction product is further reacted at temperatures in the range from 60 to 150° C. with 10 to 40, preferably 20 to 40 most preferred 25 to 35 moles of ethylene oxide forming the soil dispersants of the invention. The second step of the propoxylation and the following oxyethylation of the reaction product obtained in the first step may be carried out in an organic solvent such as xylene.

EXAMPLE 1

PEI 3000 $(PO)_3.(EO)_{27}$ 43 g of polyethyleneimine (PEI having an average molecular weight of 3000 and corresponding to 1.0 mol, with reference to ethyleneimine) is added as a 54 % by weight aqueous solution to an autoclave fitted with a stirrer under a nitrogen blanket. The autoclave is sealed and its contents is heated with stirring to 90° C. At this temperature 58 g (1 mol) of propylene oxide are pressurized. The stirring is continued until the pressure remains constant. The contents of the autoclave is then cooled to a temperature of 80° C. and 12.5 g of potassium hydroxide are added as a 40 % strength by weight aqueous solution. The water is then removed applying a vacuum of about 20 mbar. 103 g of a viscous oil is obtained.

In the second step of alkoxylation 101 g of the hydroxypropylated polyethyleneimine obtained above is placed in a stirred autoclave and is heated unter nitrogen to 120° C. The reactor is pressurized several times with nitrogen and its contents is heated to 140 to 145° C. Then 116 g (2 moles) of propylene oxide are introduced unter pressure. The reaction mixture is stirred at 140 to 145° C. until the pressure is constant. Ethylene oxide is then added in the said temperature range in an amount of 1,180 g (27 moles with reference to ethyleneimine). The reaction mixture is stirred until the pressure is constant and is then cooled to 80° C. About 1.4 kg of a viscous brown oil is obtained. The alkoxylated product becomes a brown solid at room temperature and has a melting point of 45 to 50° C.

What is claimed is:

1. A soil dispersant having the formula:

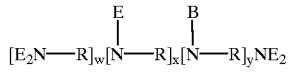

wherein R is ethylene; B is a continuation by branching; E is an alkyleneoxy unit having the formula:

$$-(R^1O)_m(R^2O)_nR^3$$

wherein $R^1$ is 1,2-propylene; $R^2$ is ethylene; $R^3$ is hydrogen; m is from about 2 to about 5; n is from about 20 to about 30; w, x, and y are each independently from about 4 to 200; provided at least one $(R^1O)$ unit is attached to the backbone prior to attachment of an $(R^2O)$ unit and further provided m+n is from about 25 to about 35, and wherein the backbone molecular weight prior to modification is from about 1200 daltons to about 20000 daltons.

2. A soil dispersant according to claim 1 wherein m is 3 and n is 27.

3. A soil dispersant according to claim 1 wherein the backbone molecular weight prior to modification is from about 2000 daltons to about 5000 daltons.

4. A soil dispersant according to claim 3 wherein the backbone molecular weight prior to modification is about 3000 daltons.

* * * * *